US006443709B1

(12) United States Patent
Jackson

(10) Patent No.: US 6,443,709 B1
(45) Date of Patent: Sep. 3, 2002

(54) OSCILLATING SPRING VALVE FLUID PUMPING SYSTEM

(76) Inventor: Robert L Jackson, 545 University Pkwy., Aiken, SC (US) 29801

( * ) Notice: Subject to any disclaimer, the term of this patent is extended or adjusted under 35 U.S.C. 154(b) by 0 days.

(21) Appl. No.: 09/644,424

(22) Filed: Aug. 23, 2000

Related U.S. Application Data

(60) Provisional application No. 60/075,575, filed on Feb. 23, 1998.

(51) Int. Cl.[7] ..... F04F 7/02
(52) U.S. Cl. ..... 417/226
(58) Field of Search ..... 417/226, 225, 417/227

(56) References Cited

U.S. PATENT DOCUMENTS

| | | | | | |
|---|---|---|---|---|---|
| 592,872 | A | | 11/1897 | Lormant | |
| 3,136,257 | A | | 6/1964 | Smith et al. | |
| 3,160,110 | A | | 12/1964 | Budzich | |
| 3,572,980 | A | | 3/1971 | Hollyday | |
| 3,655,296 | A | | 4/1972 | McDougall | |
| 3,686,687 | A | | 8/1972 | Chavarria et al. | |
| 3,700,360 | A | | 10/1972 | Shaddock | |
| 3,719,437 | A | | 3/1973 | Schuhmann et al. | |
| 3,804,554 | A | | 4/1974 | Jones | |
| 3,805,820 | A | | 4/1974 | Brady, Jr. et al. | |
| 3,806,285 | A | | 4/1974 | Sech | |
| 3,838,943 | A | * | 10/1974 | Ulbing | 417/289 |
| 4,054,399 | A | | 10/1977 | Maurer | |
| 4,073,604 | A | | 2/1978 | Chen | |
| 4,127,362 | A | | 11/1978 | Fladby | |
| 4,149,831 | A | | 4/1979 | Davis | |
| 4,392,787 | A | | 7/1983 | Notta | |
| 4,537,563 | A | * | 8/1985 | Ogawa | 417/226 |
| 4,597,511 | A | | 7/1986 | Licari | |
| 4,690,618 | A | * | 9/1987 | Akatsu et al. | 417/226 |
| 4,762,475 | A | | 8/1988 | Fuchs | |
| 5,137,435 | A | | 8/1992 | Walton | |
| 5,207,567 | A | | 5/1993 | Joy | |
| 5,271,721 | A | * | 12/1993 | Richards | 417/226 |
| 5,310,322 | A | * | 5/1994 | Richards | 417/226 |
| 5,336,061 | A | | 8/1994 | Armstrong | |
| 5,348,046 | A | | 9/1994 | Kozumplik, Jr. et al. | |
| 5,491,976 | A | | 2/1996 | Rock et al. | |
| 5,567,131 | A | | 10/1996 | McNaull | |
| 5,573,386 | A | | 11/1996 | Schmitt et al. | |
| 5,580,225 | A | | 12/1996 | Salecker | |
| 5,588,817 | A | | 12/1996 | Zirps et al. | |
| 5,639,219 | A | | 6/1997 | Conatser | |
| 6,234,764 | B1 | * | 5/2001 | Obermoser | 417/226 |

* cited by examiner

*Primary Examiner*—Mark Paschall
*Assistant Examiner*—Daniel Robinson
(74) *Attorney, Agent, or Firm*—Michael A Mann; Nexsen Pruet Jacobs & Pollard LLC

(57) ABSTRACT

An oscillating spring valve fluid pumping system for use in a flowing stream of fluid comprises a spring valve, check valve and a housing with inlet and two outlets, one outlet for each valve. As fluid enters the system, it is directed to a spring valve which is biased in the open position by a first spring. Fluid passing by the spring valve exits the housing from one of the outlets and returns to the stream. When a predetermined amount of pressure is reached, the spring valve closes thus creating a back pressure and redirecting the fluid through a check valve mechanism to relieve that pressure. Fluid passing the check valve escapes through one of the outlets for distribution by the user. Concurrently, the pressure at the spring valve is reduced thereby causing the spring valve to open against a second spring. As fluid continues to enter the system, the spring valve repeatedly oscillates thus producing an increased pressure head at the system outlet. Because this system requires no motor or other electrical source, it is both light weight and inexpensive, thus making it ideal for applications in remote areas where electricity is not readily available.

7 Claims, 7 Drawing Sheets

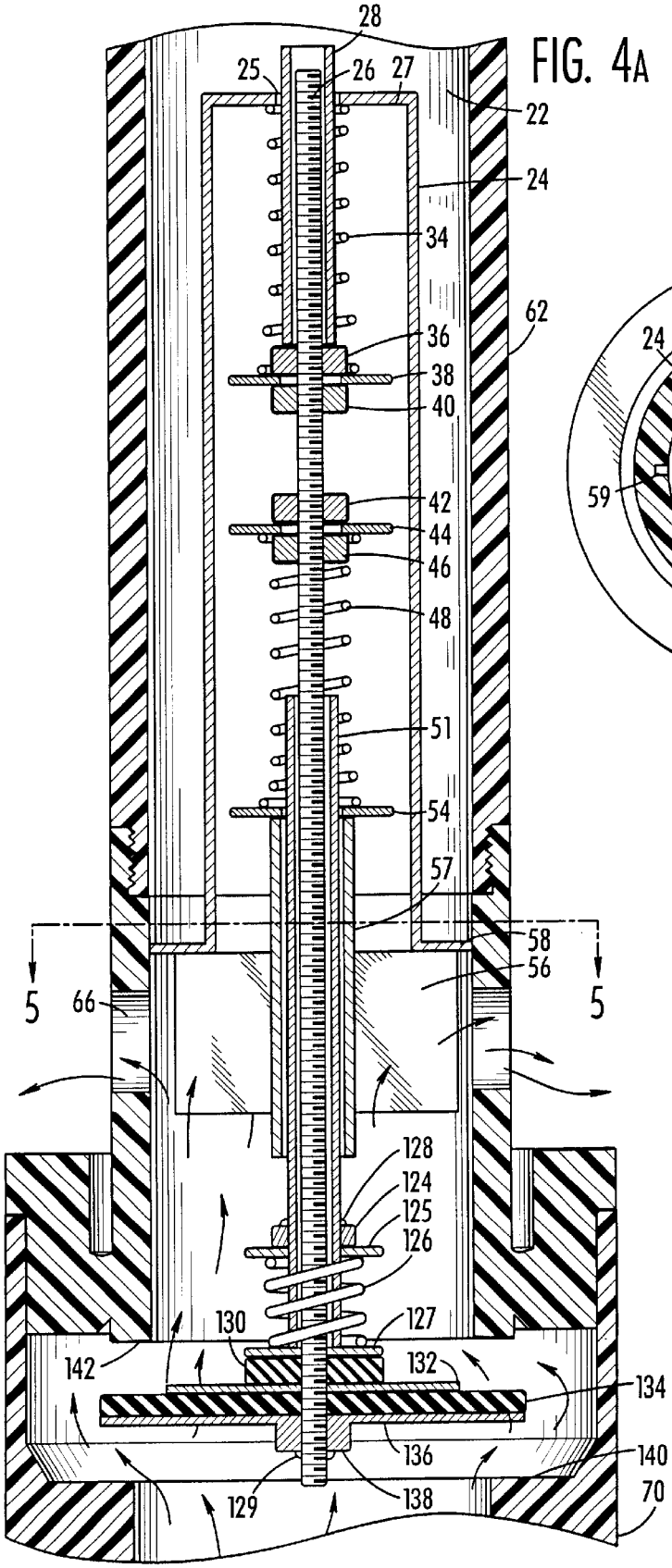
FIG. 4A
FIG. 5
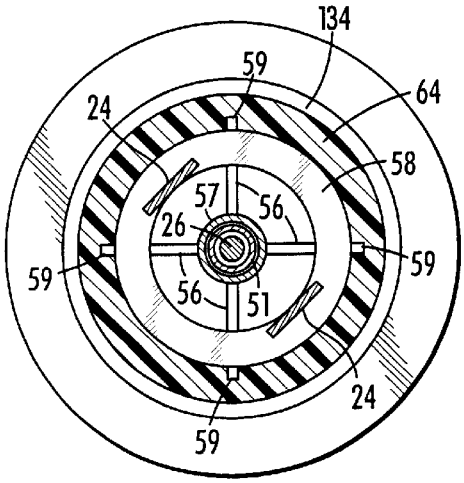

OSCILLATING SPRING VALVE FLUID PUMPING SYSTEM

PRIORITY CLAIM:

This application claims the benefit of U.S. Provisional Application No. 60/075,575, filed Feb. 23, 1998, and PCT/US99/03903 filed Feb. 23, 1999.

BACKGROUND OF THE INVENTION

1. Field of the Invention

The present invention relates generally to fluid pumping systems. In particular, the present invention relates to an oscillating spring valve fluid pumping system.

2. Background of the Invention

Pumping fluid from a flowing source of the fluid (i.e., water from a river) in order to redirect the fluid for other applications, such as irrigation or filling a tank with water, has been the object of a number of pumping systems. However, most systems require the use of an electrical or other type of motor. This requirement limits the use of many systems in areas where electricity is not readily available. Although combustion engines are typically used as an alternative source of power in remote areas, these are relatively expensive, inconvenient to transport, and not always readily available in remote locations. Furthermore, generators cannot operate pumps for extended periods of time without refueling.

Manual pumps (i.e., hand pumps) may also be used in remote areas. Manual pumps are less expensive than those powered by electricity or combustion engines. However, because manual pumps require an operator, they are typically used in one-time-use applications or short-term applications.

Solar powered pumps are also used to partially remedy the above mentioned shortcomings. However, solar powered pumps are not without limitations. For instance, this type of pump is at the mercy of available sunlight and may limit the size of the pump to very small applications. Although the coupling of rechargeable backup battery sources can be used to reduce this limitation, such a system would be relatively expensive and not readily available to most users in remote areas.

As such, there is a need for a pumping system capable of utilizing the pressure head produced by the flowing fluid (i.e., river) to operate the pump and produce an increased pressure head so that the fluid may be redirected for other applications.

SUMMARY OF THE INVENTION

According to its major aspects and broadly stated, the present invention is an oscillating spring valve fluid pumping system. The system comprises a housing that encloses a check valve, an inlet and two outlet orifices, and a spring control valve. The system uses the pressure of the flowing fluid against the spring valve and the resulting water hammer as a power source to pump a portion of the fluid. The check valve is located past the inlet and the spring valve is located past the check valve and at a lower elevation. The spring valve closes when pushed up hard enough against the spring by the force of the flowing water; the check valve opens when pushed up. When the flowing water pressure is not great enough to close the spring valve, fluid flows from the pump past the spring valve and through its outlet and back to the fluid stream. When the flowing fluid closes the spring valve, the back pressure opens the check valve and the fluid is expelled through one of the outlets by the pump for use in irrigation, etc. By setting the spring valve to oscillate (somewhat like starting a pendulum of a clock to swinging but with the flowing fluid continually suppling energy to maintain the oscillations), the two valves will then continue to oscillate under pressure from the flowing fluid and will pump fluid from the check valve's outlet.

The spring control valve alternately opens and closes 180° out of phase with the opening and closing of the check valve to produce an outlet pressure head proportional to the water hammer that results when the spring valve closes and backs up the pressure in the housing. More specifically, in an initial state of rest, the spring control valve is in an open position while the check valve is in a closed position. As fluid flows through the system, a predetermined amount of fluid is allowed to pass around the open spring control valve and return to the source stream downstream of the pump inlet. At a predetermined pressure, the spring control valve closes causing the fluid to be redirected through the check valve and thus through the outlet. Instantaneously, as the fluid is redirected, the pressure at the spring valve drops causing the spring control valve disk to spring open thus causing a hammer affect upon the fluid. On the upward return of the spring control valve disk, the fluid is again redirected through the check valve, but at an increased pressure head. Both the spring control valve and the check valve oscillate through this repeating cycle, resulting in a continuous hammering effect on the fluid. Given a flow rate of the stream of fluid and a diameter of the piping, the spring setting on the spring control valve can be adjusted to maximize the outlet pressure head and/or to achieve a predetermined outlet pressure head, preferably, at 80–90 cycles per minute.

In a preferred embodiment, the fluid enters the system through a flared inlet and is directed through a series of elbow joints so that the fluid is flowing in a vertical direction when it contacts the spring control valve and the spring control valve is at approximately the same elevation of the fluid when it enters the flared inlet. This arrangement provides the maximum available force against the horizontal disk of the spring control valve thus facilitating the vertical oscillation of the spring control valve. The spring control valve is positioned vertically so that gravity can be used to open the valve. Additionally, two independently operating springs are used on the spring control valve so that one provides an upward force when the disk is in its lower extended position, and the other provides a downward force when the disk is in the upper closed position for greater control over the frequency of oscillation. The amounts of upward and downward spring force can vary depending on several factors including, fluid flow rate, pipe diameter, horizontal position of the disk relative to the stream of fluid flow at the inlet, and the weight of the spring control valve. However, these variables can be easily compensated for by rotating a set of adjustment nuts to increase or decrease the spring tension.

A feature of the present invention is the alternating opening and closing of the spring control valve and the check valve to produce an outlet pressure head. No motor or other power source is required because the power for the pump comes from the flowing fluid itself harnessed by the springs of the spring valve; nonetheless, with the appropriate spring adjustments, a predetermined increase in pressure head results at the system outlet. Additionally, because the present invention requires no motors and because any unused fluid is recycled back into the source stream, the present invention is environmentally friendly.

Other features and their advantages will be apparent to those skilled in the art from a careful reading of the Detailed Description of Preferred Embodiments accompanied by the following drawings.

BRIEF DESCRIPTION OF THE DRAWINGS

In the drawings,

FIG. 4A is a cross-sectional side view of a spring control valve according to a preferred embodiment of the present invention, in an open position.

FIG. 5 is a cross-sectional top view of a spring control valve according to a preferred embodiment of the present invention.

DETAILED DESCRIPTION OF PREFERRED EMBODIMENTS

Figure 1:
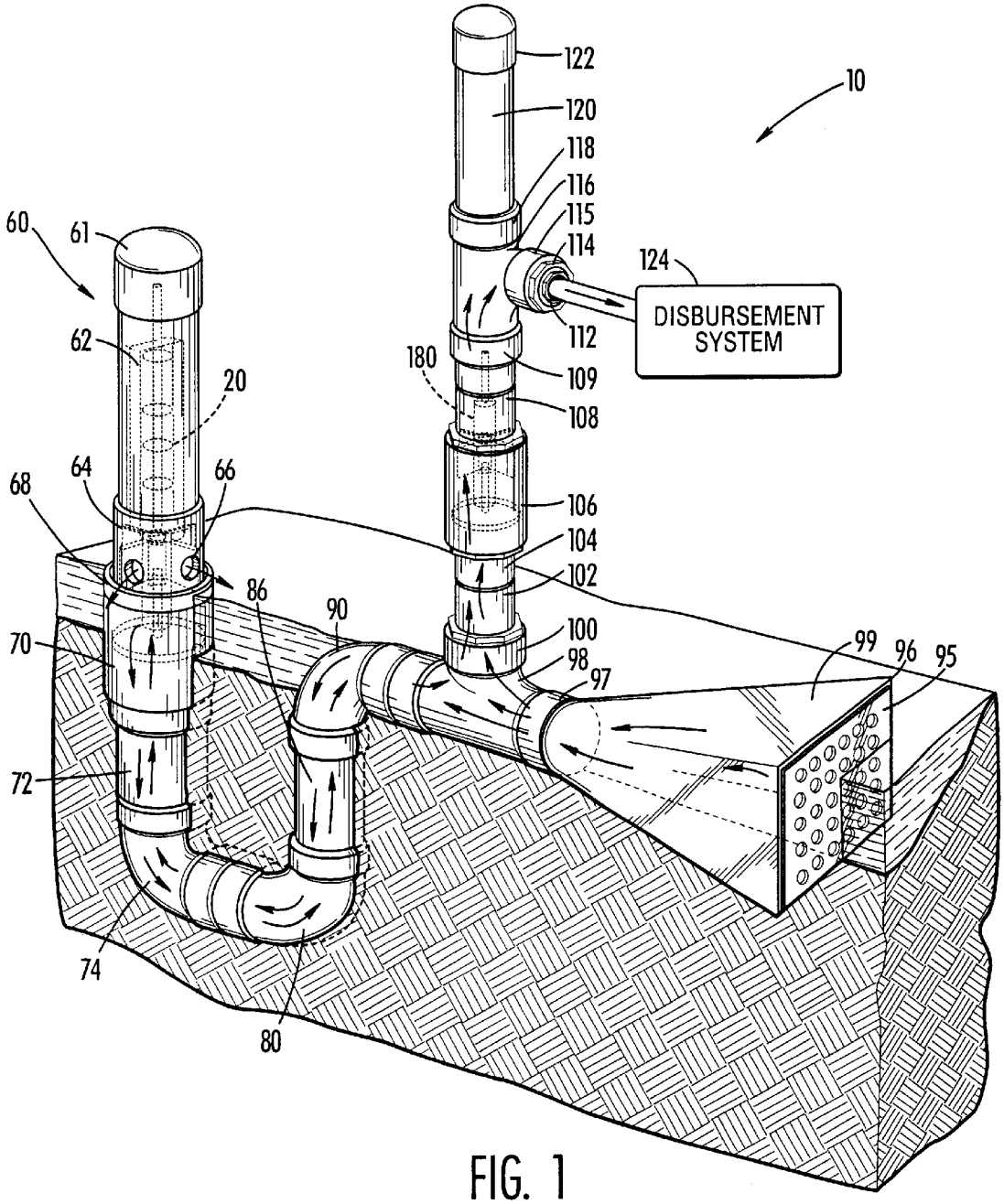
FIG. 1 is a perspective view of an oscillating spring valve fluid pumping system according to a preferred embodiment of the present invention.

The present invention is an oscillating spring valve fluid pumping system. Referring now to the figures, there is shown a preferred embodiment of the present invention, indicated generally by reference numeral 10. Device 10 comprises spring control valve mechanism 20 and check valve mechanism 180 cooperating through a series of piping 60.

Referring now to FIGS. 4A, 4B, 4C, and 5, spring control valve mechanism 20 comprises, preferably, three springs 34, 48, 126, five spring support washers 38, 44, 54, 125, 127, two spring control valve stem covers 28, 51, six nuts 36, 40, 42, 44, 124, 138, gasket 130, elongated threaded spring control valve stem 26, u-shaped spring control valve stem support 24, four support fins 56, stem support tube 57, stem support ring 58, two seal support rings 132, 136, and seal ring 134. Elongated threaded spring control valve stem 26 is centered within spring mechanism pipe housing 62 in a vertical position by u-shaped spring control valve stem support 24, support fins 56, stem support tube 57, and stem support ring 58 so that spring control valve mechanism 20 can utilize gravity to facilitate oscillation. Vertically positioned stem support tube 57 is rigidly attached to horizontal support fins 56 which are secured to pipe linkage 64 within slots 59. Stem support ring 58, carried by support fins 56, is rigidly attached to and provides support for u-shaped spring control valve stem support 24. Elongated threaded spring control valve stem 26 is positioned through opening 25 of u-shaped spring control valve stem support 24 and stem support tube 57 thus securing elongated threaded spring control valve stem 26 in a vertical position but allowing movement in the upward and downward direction.

Secured on lower portion of elongated threaded spring control valve stem 26 by gasket 130 and sixth nut 138, and sandwich therebetween is first seal support ring 132, seal ring 134, and second seal support ring 136. To prevent movement during operation, sixth nut 138 is secured, preferably, by tack weld 209, to elongated threaded spring valve stem 26. First seal support ring 132 has a radius smaller than seal ring 134 so as to allow seal ring 134 to contact bottom surface 142 of spring mechanism pipe housing 62, thereby producing a seal when spring control valve 20 is in the closed position. Second seal support ring 136 acts as a hammering surface while spring control valve 20 is in operation.

First spring control valve spring cover 28 is carried by elongated threaded spring control valve stem 26 to prevent snagging and to facilitate vertical movement of elongated threaded spring control valve stem 26 through opening 25 of u-shaped spring control valve stem support 24. First spring control valve spring cover 28 is supported in a fixed vertical position, relative to elongated threaded spring control valve stem 26, by first nut 36.

Carried by the upper area of elongated threaded spring control valve stem 26 is first spring control valve spring cover 28, first spring 34, first spring support washer 38, and first and second nut 36 and 40, respectively. First spring support washer 38 is secured between first nut 36 and second nut 40 in a fixed position, relative to elongated threaded spring control valve stem 26. First spring 34 is interposed between top surface of first spring support washer 38 and surface 27 of u-shaped spring control valve stem support 24 wherein first spring 34 urges elongated threaded spring control valve stem 26 in the downward direction when spring control valve mechanism 20 is in the closed position.

Carried by the middle area of elongated threaded spring control valve stem 26 is third and fourth nut 42 and 46, respectively, second and third spring support washers 44 and 54, respectively, and second spring control valve stem cover 51. Third spring support washer 54 rest upon and is supported by the top surface of stem support tube 57. Second spring 51 is interposed between top surface of third spring support washer 54 and bottom surface of second spring support washer 44. Second spring support washer 44 is secured between third nut 42 and fourth nut 46 in a fixed position, relative to elongated threaded spring control valve stem 26 wherein second spring 48 urges elongated threaded spring control valve stem 26 in the upward direction when spring control valve mechanism 20 is in the extended position.

Secured, preferably by tack weld 128, on the lower portion of second spring valve stem cover 51, but sufficiently low enough to avoid contact with stem support tube 57 during operation of spring control valve mechanism 20, is fifth nut 124. Interposed between fifth nut 124 is fourth spring support washer 125 and fifth spring support washer 127 and interposed therebetween is third spring 126. Through fourth spring support washer 125, the force exerted by the lower surface of third spring 126 compresses gasket 130 thereby forming a watertight seal to prevent leakage through the contact area between first seal support ring 132, seal ring 134, second seal support ring 136, and elongated threaded spring valve stem 26.

Figure 2A:
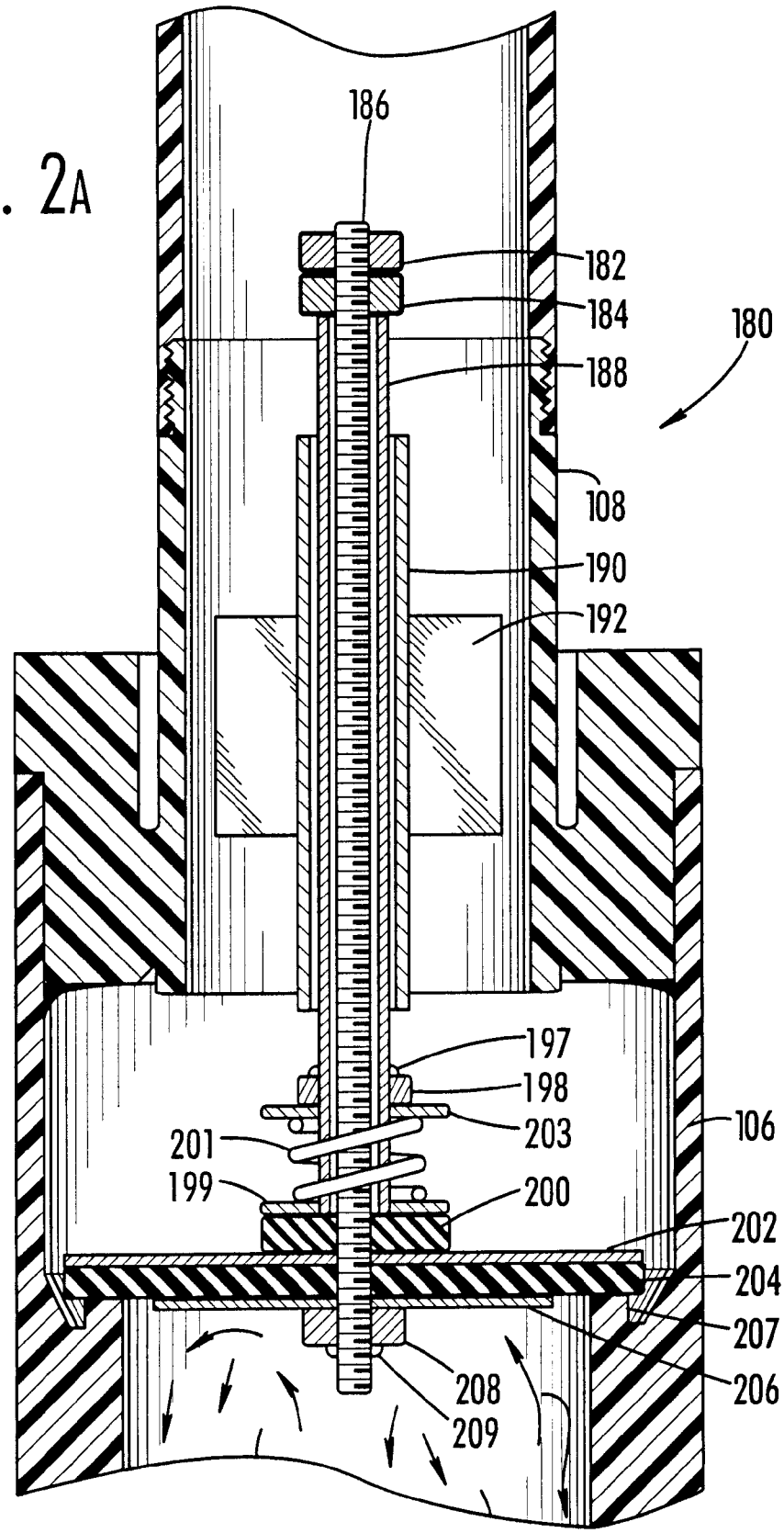
FIG. 2A is a cross-sectional side view of a check valve according to a preferred embodiment of the present invention, in a closed position.
Figure 2B:
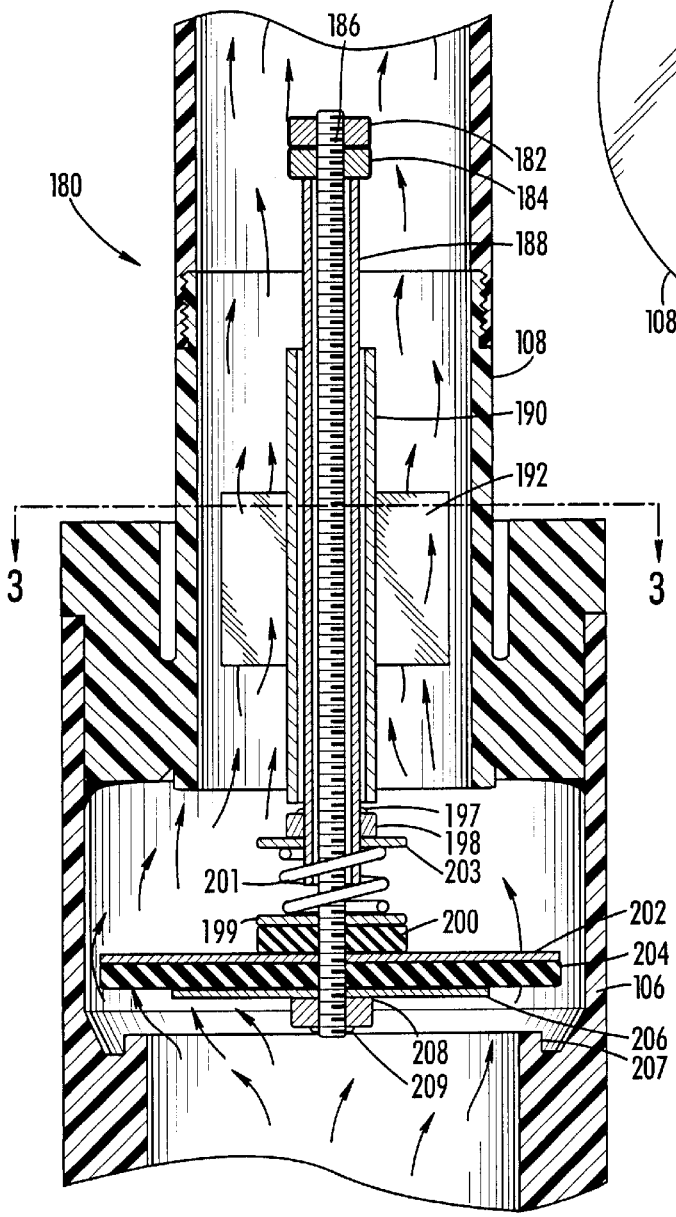
FIG. 2B is a cross-sectional side view of a check valve according to a preferred embodiment of the present invention, in an open position.
Figure 3:
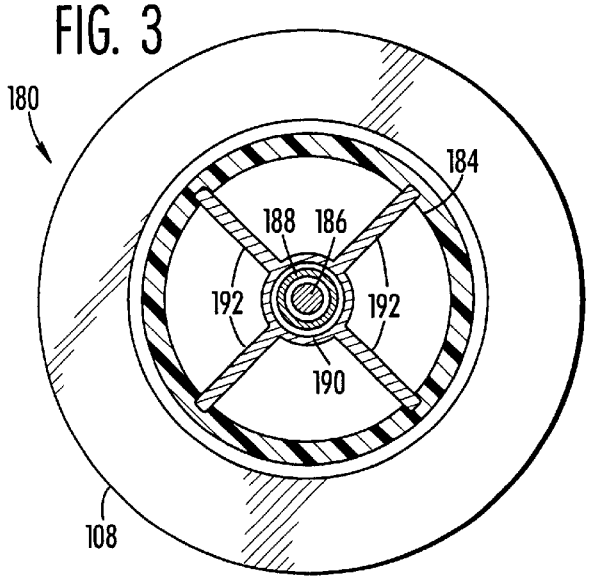
FIG. 3 is a cross-sectional top view of a check valve according to a preferred embodiment of the present invention.
Figure 4B:
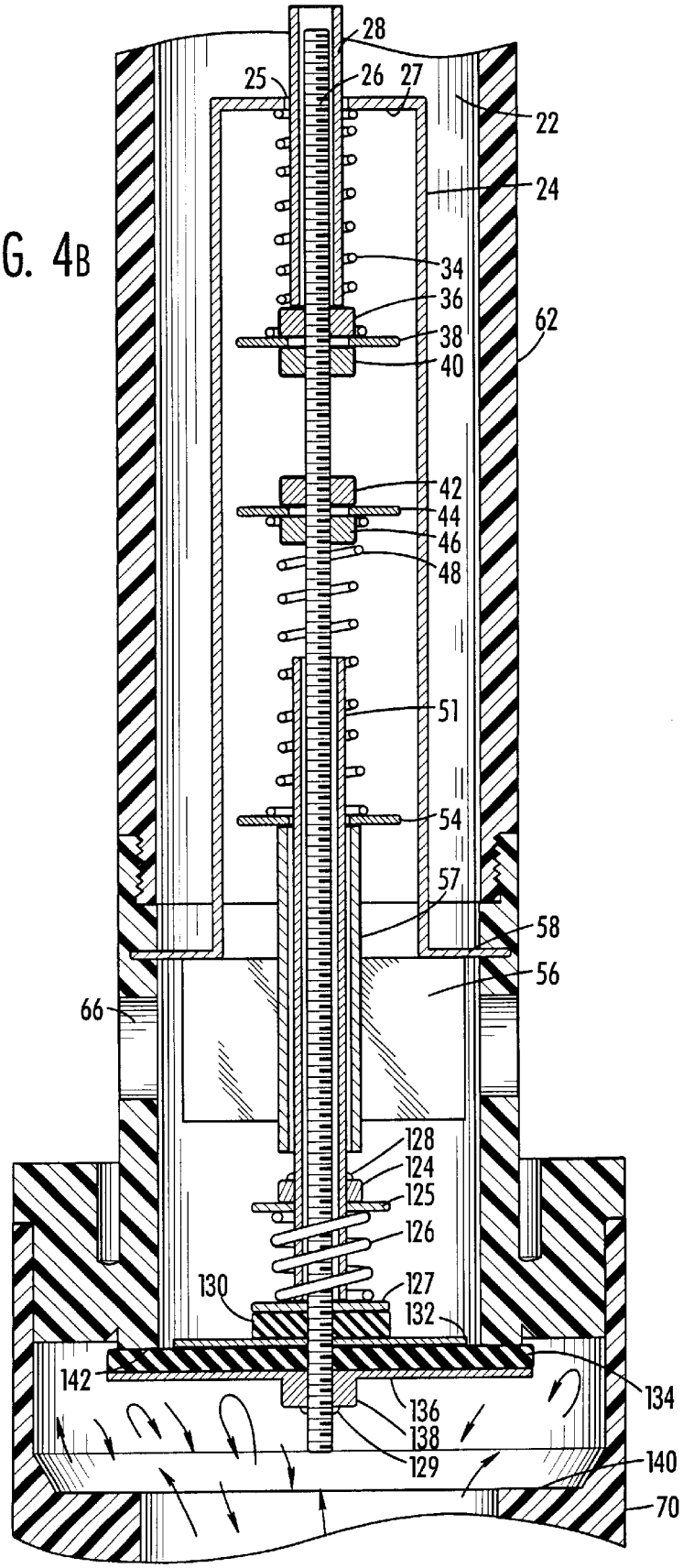
FIG. 4B is a cross-sectional side view of a spring control valve according to a preferred embodiment of the present invention, in a closed position.
Figure 4C:
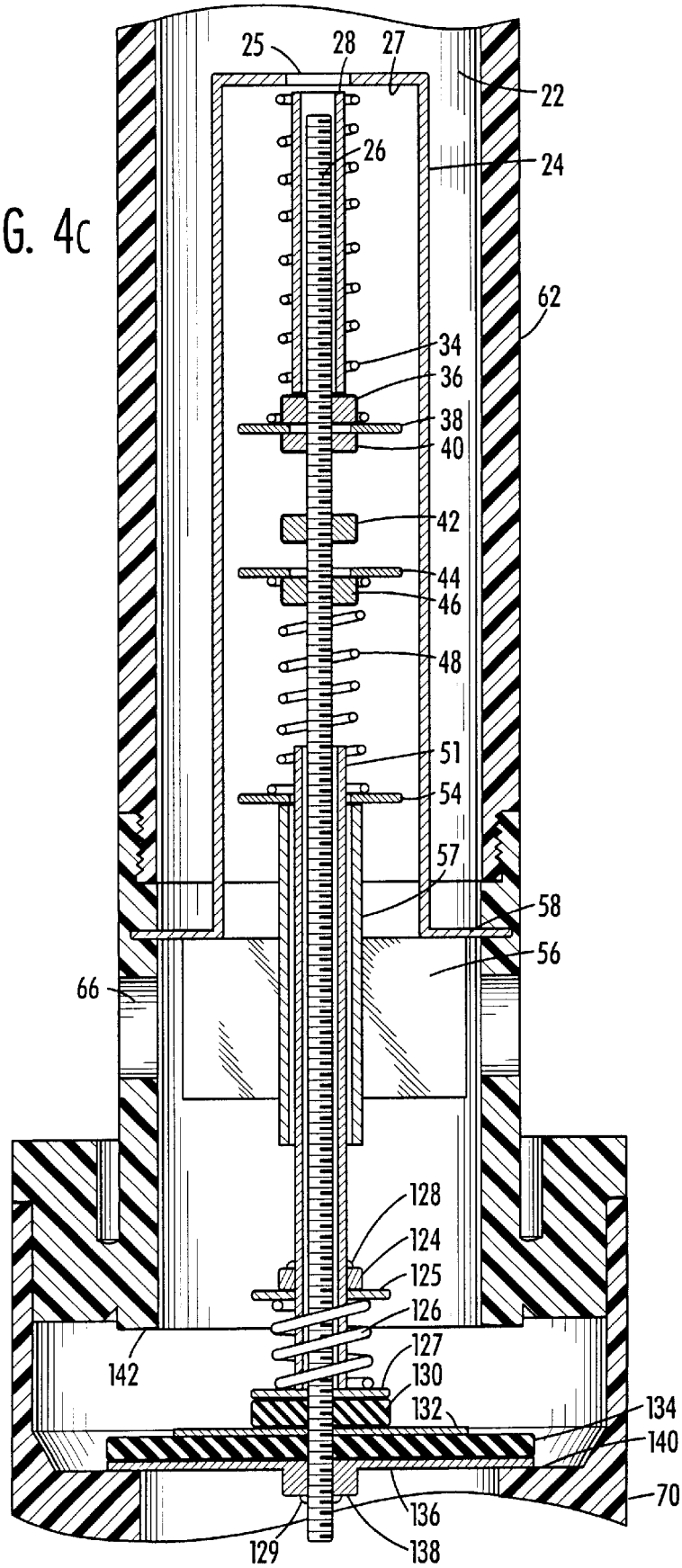
FIG. 4C is a cross-sectional side view of a spring control valve according to a preferred embodiment of the present invention, in an extended position.

Referring now to FIGS. 2A, 2B, and 3, check valve mechanism 180 comprises, preferably, four nuts 182, 184, 198, 208, gasket 200, two washers 199, 203, spring 201, elongated threaded check valve stem 186, check valve stem cover 188, check valve support tube 190, four support fins 192, two seal support rings 202, 206, seal ring 204 and valve seat 207. Elongated threaded check valve stem 186 is centered within check valve housing pipe 106 and check valve extension pipe 108 in a vertical position by support fins 192 and stem support tube 190. Vertically positioned stem support tube 190 is rigidly attached to horizontal support fins 192 which are secured to check valve extension pipe 108 within slots 194.

Secured to lower portion of elongated threaded check valve stem 186 by gasket 200 and fourth nut 208 and sandwiched therebetween is first seal support ring 202, seal ring 204, and second seal support ring 206. To prevent movement during operation, fourth nut 208 is secured, preferably, by tack weld 209, to elongated threaded check valve stem 186. Second seal support ring 206 has a radius smaller than seal ring 204 so as to allow seal ring 204 to contact valve seat 207 of check valve housing pipe 106, thereby sealing check valve mechanism 180 is in the closed position. First nut 182 and second nut 184 are thread to the top area of elongated threaded check valve stem 186.

Secured, preferably by tack weld 197, on the lower portion of check valve stem cover 188, but sufficiently low enough to avoid contact with stem support tube 190 during operation of check valve mechanism 180, is third nut 198. Interposed between third nut 198 is first washer 199 and second washer 203 and interposed therebetween is spring 201. Through first washer 199, the force exerted by the lower surface of spring 201 compresses gasket 200 thereby forming a watertight seal to prevent leakage through the contact area between first seal support ring 202, seal ring 204, second seal support ring 206, and elongated threaded check valve stem 186.

To prevent snagging and to facilitate vertical movement of elongated threaded check valve stem 186 within stem support tube 190, check valve stem cover 188 is interposed between third nut 200 and second nut 184 and carried by elongated threaded check valve stem 186.

Referring now to FIG. 1, piping configuration of invention 10 is formed by the connection and linkage of a series of pipes forming piping 60. Housing for spring control valve mechanism 20 is defined by first cap 61, spring mechanism housing pipe 62, first pipe coupling 64, and spring valve seal chamber 70. First cap 61 is attached to top of spring mechanism housing pipe 62. Attached to bottom of spring mechanism housing pipe 62 and linking spring valve seal chamber 70 thereto, is first pipe coupling 64. Evenly spaced about circumference of first pipe coupling 64 are fluid return throughholes 66, preferably four, for returning fluid that bypasses spring control valve 20. Spring valve seal chamber 70 must have an interior diameter sufficient for spring control valve mechanism 20, more specifically seal ring 134, to freely oscillate up and down.

Beginning at the bottom of spring valve seal chamber 70, the following piping is connected in series to link spring valve seal chamber 70 with first T-pipe 98: first extension pipe 72, first elbow pipe 74 (inverted right), second elbow pipe 80 (inverted left), second extension pipe 86, and third elbow 90 (right), preferably so that the fluid flow through inlet 96 is redirected to flow vertically through spring control valve mechanism 20, thereby providing the maximum force on second ring 136 to facilitate oscillation. Preferably, piping length should be selected such that inlet 96 is on the same approximate horizontal plane with spring valve seal chamber 70 to equalize the pressure head between the fluid flow at the inlet and the fluid flow through spring control valve mechanism 20.

To prevent the entrance of detrimental material into device 10, weir 95 is attached to flared inlet extension 99 at inlet 96. Flared inlet extension 99 is utilized to increase the amount of captured fluid at inlet 96. Flared inlet extension 99 is connected to first T-pipe 98 at first lip 97. In order to further increase outlet pressure head, reduction extension pipe 102 is attached at second lip 100 of first T-pipe 98. First coupling 104 is connected to top of reduction extension pipe 102 and bottom of check valve housing pipe 106. Housing for check valve mechanism 180 is defined by the connection of check valve extension pipe 108 and check valve housing pipe 106 thereby positioning check valve mechanism 180 above T-pipe 98 so as not to interfere with fluid flow through inlet 96. Check valve housing pipe 106 must have an interior diameter sufficient to allow check valve mechanism 180, more specifically seal ring 204, to freely oscillate up and down.

Connecting check valve extension pipe 108 to second T-pipe 116 is second coupling 109. Fourth pipe extension 120 is connected to second T-pipe 116 at lip 118. Second cap 122 is connected to top of fourth pipe extension 120. In order to further increase the outlet pressure head, reduction fitting 114 is connected to lip 115 of second T-pipe 116 and thus defines outlet orifice 112. Outlet orifice 112 can be connected to a multitude of well known disbursement systems 124 for specific applications or discharge the pumped fluid into a tank.

Because gravity is utilized within the device 10 to facilitate oscillation, the housing for both spring control valve mechanism 20 and check valve mechanism 180 should be maintained in a substantially vertical position for proper operation and spring control valve mechanism 20 should be positioned below check valve mechanism 180. The connection means for individual parts of piping system 60 can be an adhesive compound, threaded fittings, or other suitable watertight connecting means.

When device 10 is inserted into a stream of fluid flow, and spring control valve mechanism oriented so that it is approximately at the same elevation as the fluid at inlet 96, spring control valve mechanism 20 is initially in an open position and check valve mechanism 180 is initially in the closed position. Therefore, traveling the path of less resistance, the fluid travels via series of pipe 60 through spring control valve mechanism 20 and out fluid return throughholes 66. By pressing briefly on spring control valve mechanism 20 to start it oscillating, the pumping action is initiated. When the pressure of the flowing fluid upon second ring 136 is high enough, spring control valve mechanism 20 is forced shut thereby causing a back-pressure and redirecting the fluid to press against check valve mechanism 180. This "water hammer" pressure is sufficient to open check valve mechanism 180 and allow fluid to flow through outlet orifice 112. Once check valve mechanism 180 opens, the pressure at spring control valve mechanism 20 is subsides thereby allowing spring control valve mechanism 20 to spring open again. But the springs and the water pressure cause it to shut again, thus continuing the oscillations and controlling the rate of oscillation. This oscillation between spring control valve mechanism 20 and check valve mechanism 180 will continuously repeat at preferably 40–60 cycles per minute for maximum output.

Figure 6:
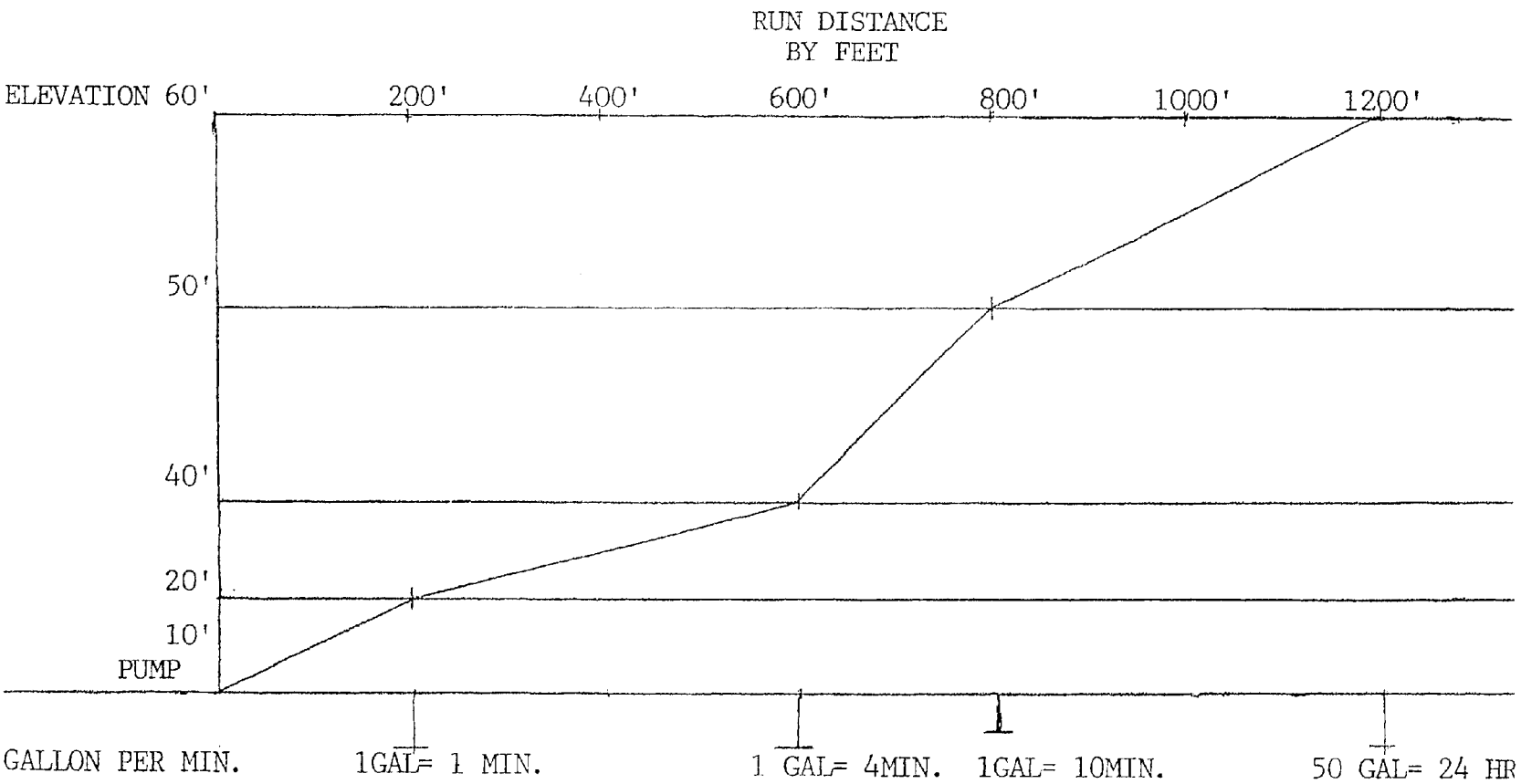
FIG. 6 is a chart showing the performance of a pump, according to a preferred embodiment of the present invention.

FIG. 6 is a chart showing the performance of a pump made according to a preferred embodiment of the present invention. The pump used developed an output of 50 gallons in a 24 hour period from a source 1200 feet away. The pipe from the source to the output was a three inch diameter pipe. Greater output can be obtained at the expense of lower pressure.

It will be apparent to those skilled in the art that many changes and substitutions can be made to the preferred embodiment herein described without departing from the spirit and scope of the present invention, which is defined by the appended claims.

What is claimed is:

1. A pump for use in a flowing stream, comprising;

a housing with an inlet, a distribution outlet and a return outlet, said housing formed to permit a flow of a fluid through said housing from said inlet to said distribution outlet and said return outlet;

a spring control valve carried by said housing and located between said return outlet and said inlet, said spring valve having a first spring for urging said spring valve open and a second spring for urging said spring valve closed, said first and said second springs operating independently; and a check valve carried by said housing and located between said spring valve and said inlet, said housing formed so that, when said housing is placed in a flowing stream, said spring control valve is at the same elevation as said inlet and said check valve is at a higher elevation than said inlet.

2. The pump as recited in claim 1, wherein said spring control valve has a disk and wherein said disk lies in a plane perpendicular to the direction of said flow of said fluid through said housing when said housing is placed in said flowing stream.

3. The pump as recited in claim 2, wherein said check valve has a disk and wherein said disk of said check valve lies in a plane perpendicular to the direction of said flow of said fluid through said housing when said housing is placed in said flowing stream.

4. The pump as recited in claim 1, wherein said inlet is flared.

5. The pump as recited in claim 1, further comprising a weir carried by said inlet.

6. The pump as recited in claim 1, wherein said spring control valve is oriented to oscillate vertically.

7. The pump as recited in claim 6, wherein said check valve is oriented to move vertically between an open and closed position.

* * * * *